United States Patent [19]

Hill

[11] Patent Number: 4,928,312

[45] Date of Patent: May 22, 1990

[54] ACOUSTIC TRANSDUCER

[76] Inventor: Amel Hill, 2837 Summer Brooke Way, Carrelbury, Fla. 32707

[21] Appl. No.: 262,946

[22] Filed: Oct. 17, 1988

[51] Int. Cl.[5] ..... H04R 7/06; G10K 13/00

[52] U.S. Cl. ..... 381/192; 381/202; 381/205; 181/174

[58] Field of Search ..... 381/192–194, 381/197, 202, 204, 152, 188, 205; 181/163, 164, 171, 174

[56] References Cited

U.S. PATENT DOCUMENTS

| | | | |
|---|---|---|---|
| 2,685,935 | 8/1954 | Lenz | 181/164 |
| 2,815,823 | 12/1957 | Olson et al. | 181/164 |
| 3,569,638 | 3/1971 | Schoengold | 381/193 |
| 3,573,396 | 4/1971 | Schoengold | 381/202 |
| 3,596,733 | 8/1971 | Bertagni | 381/202 |
| 3,801,943 | 4/1974 | Bertagni | 381/158 |
| 4,003,449 | 1/1977 | Bertagni | 381/202 |
| 4,308,155 | 12/1981 | Tada et al. | 252/62.54 |
| 4,330,691 | 5/1982 | Gordon | 381/205 |

FOREIGN PATENT DOCUMENTS

| | | | |
|---|---|---|---|
| 0137400 | 8/1983 | Japan | 381/192 |
| 1186722 | 4/1970 | United Kingdom | 381/202 |

*Primary Examiner*—Jin F. Ng
*Assistant Examiner*—Wing F. Chan
*Attorney, Agent, or Firm*—William M. Hobby, III

[57] ABSTRACT

An acoustic transducer loudspeaker for converting variations of electrical energy into corresponding variations of acoustic energy is formed of one piece of foamed polymer material having different densities in different portions thereof. The one piece of foamed polymer material has a periphery portion of one density and a diaphragm portion formed in the center thereof and a resilient diaphragm suspension portion separating the periphery porition from the diaphragm portion and having a flexible polymer insert attached in a recess over the diaphragm suspension portion. A voice coil is fixedly attached to the diaphragm portion and a frame is mounted to the foamed polymer sheet periphery portion and extends over the diaphragm portion to support a permanent magnet thereon for alignment with the voice coil. A laminated cover panel can be laminated to the front of the foamed polymer sheet to provide a speaker and a ceiling tile or wall panel without a visible grill.

15 Claims, 2 Drawing Sheets

ACOUSTIC TRANSDUCER

BACKGROUND OF THE INVENTION

The present invention relates to an acoustic transducer or loud speaker and especially to an acoustic transducer panel formed of a foamed polymer material and laminated to an acoustic panel.

An acoustic transducer or loud speaker is a device for converting variations of electrical energy into corresponding variations of acoustical energy or sound. A loudspeaker generally has a diaphragm, such as a paper cone, which is resiliently mounted to a frame and is set in motion by an armature which is energized by the speaker current. A dynamic or moving coil loudspeaker has the armature vibrating in a magnetic field and consists of a coil attached to a conical diaphragm. An electro-dynamic speaker has the moving coil oscillating inside an electro-magnet which is energized with direct current while a permanent magnet moving coil speaker has the coil oscillating in a cavity of a specially shaped permanent magnet. Thus the loud speaker uses the electro-dynamic principal for the conversion of the electric oscillations into mechanical vibrations which in turn produce sound waves in the air.

The present invention relates to this type of speaker but especially to such a speaker formed into a foamed polymer panel which can have a ceiling tile facia or the like laminated thereto for directing the acoustical energy into a room without any visible grills or speaker components. The present invention is also related to a panel having the diaphragm and the resilient diaphragm suspension and a portion of the supporting frame formed in a single piece of molded foamed polymer material having different densities in the different portions of the panel and having a flexible insert attached in a recess to form the diaphragm suspension.

In the past a variety of U.S. patents have mounted dynamic speakers directly into ceiling tiles and these can be seen in the Stallings, Jr. U.S. Pat. No. 4,057,689 for a high-fidelity sound reproduction system having a plurality of sound modules mounted on a number of baffle plates to define a ceiling and in the U.S. Pat. No. 4,484,658 to Grote for a speaker support assembly. The Grote patent mounts a dynamic loud speaker to a support assembly having a baffle and brackets and having the baffle located below a ceiling panel with the speaker extending through the ceiling panel. The Walker U.S. Pat. No. 4,123,621 is for an acoustical speaker device adapted to be recessed into the ceiling of a room. Similarly, the Junk U.S. Pat. No. 3,666,040 is a ceiling mounting ring for a speaker cone for mounting the speaker into the ceiling of a room. The Sepmeyer U.S. Pat. No. 3,985,200 is for a background sound system in which a loud speaker is bolted directly to a ceiling panel of a suspended ceiling. The Marquiss U.S. Pat. No. 4,385,210 is for an electro-acoustical planar transducer which uses a planar diaphragm driven by a strategically located coil driven permanent magnets. The voice coils are used to drive the planar diaphragms. In the Bertagni U.S. Pat. Nos. 3,801,943 and 3,596,733 flat diaphragm sound transducers are disclosed in which a foamed plastic diaphragm is driven by a coil within a permanent magnet with the permanent magnet supported to a metal frame for driving the flat diaphragm.

In contrast to this prior art, applicant has an improved system for use with ceiling tile facias and the like in which the ceiling tile facia matches the remaining ceiling tiles is laminated to a foamed polymer panel molded specifically to act as a planar diaphragm as well as the resilient diaphragm suspension and new supporting frame for supporting the magnet and magnet supporting frame thereon by using both molded shapes and variable densities in the foamed polymer materials.

SUMMARY OF THE INVENTION

An electro-acoustic transducer or loud speaker has a one piece sheet of foamed polymer material, such as an expanded polystyrene foam, having different densities in different portions thereof. The sheet of foamed polymer material has a periphery portion of one density connected to a rigid diaphragm portion formed in the middle thereof and supported on a resilient diaphragm suspension portion separating the resilient portion from the diaphragm portion and having an insert of a density lower than the periphery portion one density and lower than the resilient diaphragm suspension density inserted into a cutout in the sheet of foamed polymer material surrounding the diaphragm portion. The insert is adhesively attached to the sheet of foamed polymer material in the cutout. A voice coil is fixedly attached through the diaphragm portion and at least one frame support portion is formed on the periphery portion of the foamed polymer material. A frame is attached to the sheet of foamed polymer periphery portion frame support portion and extends over a portion of the diaphragm portion. The frame has a magnet attached thereto in a position to be aligned with the voice coil to form a panel speaker. A laminated polymer ceiling tile cover has the same pattern as an existing ceiling tile and can be fixedly attached to one side of the polymer material and may have removed portions directly in front of the voice coil and adjacent the resilient diaphragm suspension of the foamed polymer material. The voice coil extends through the sheet of polymer material diaphragm portion and has a flared portion to enhance the high frequencies emanating from the speaker. The diaphragm portion of the foamed polymer material has a plurality of reinforcing ribs extending radially from an annular raised center adjacent the voice coil opening to the outer edge of the resilient diaphragm suspension portion. The voice coil is adhesively attached to the foamed polymer diaphragm portion and the frame is a molded plastic frame having a light weight permanent magnet attached thereto and having an opening therein for the voice coil to move therein.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
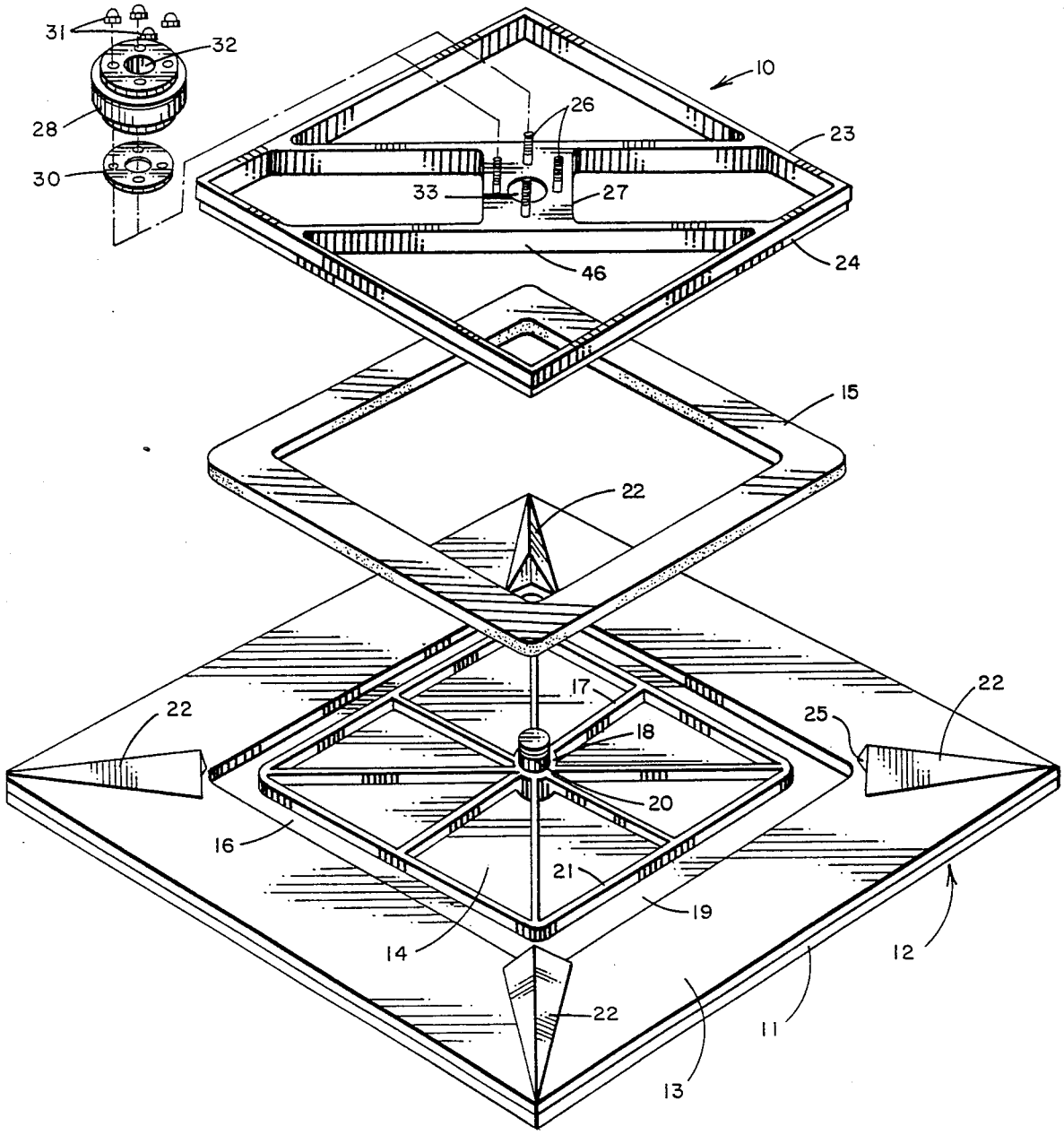
FIG. 1 is an exploded perspective view of a loud speaker in accordance with the present invention.
Figure 2:
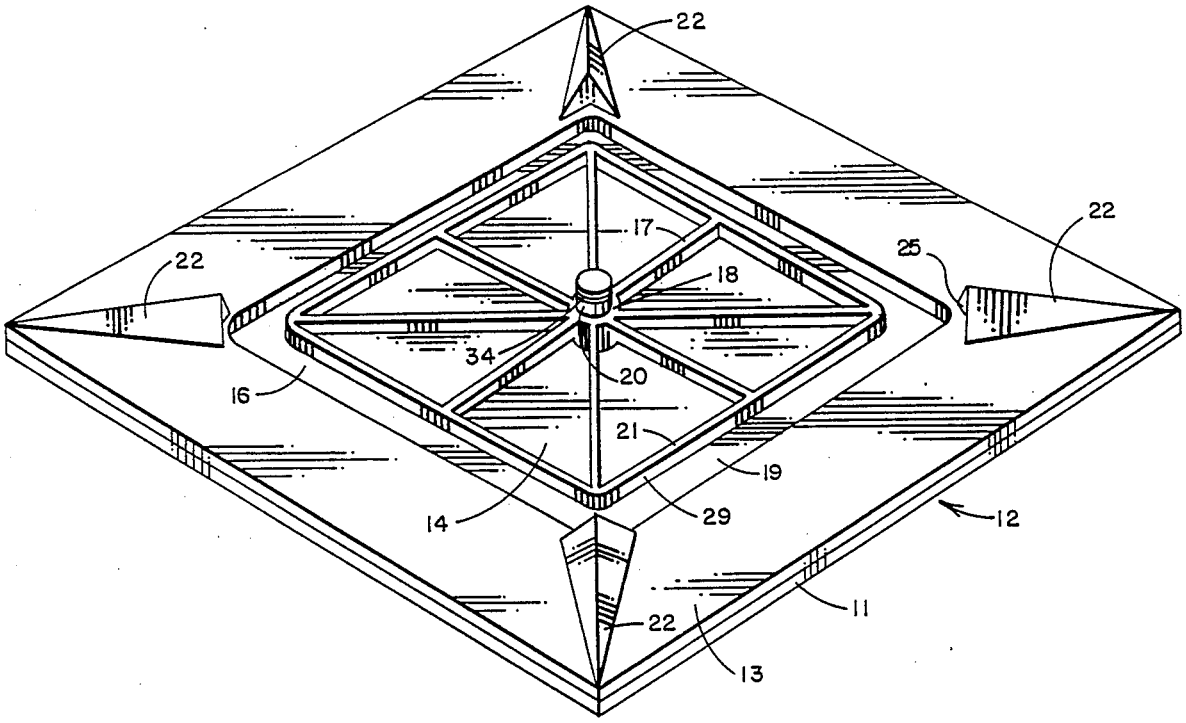
FIG. 2 is a perspective view of the molded polymer speaker panel having the voice coil attached thereto.
Figure 3:
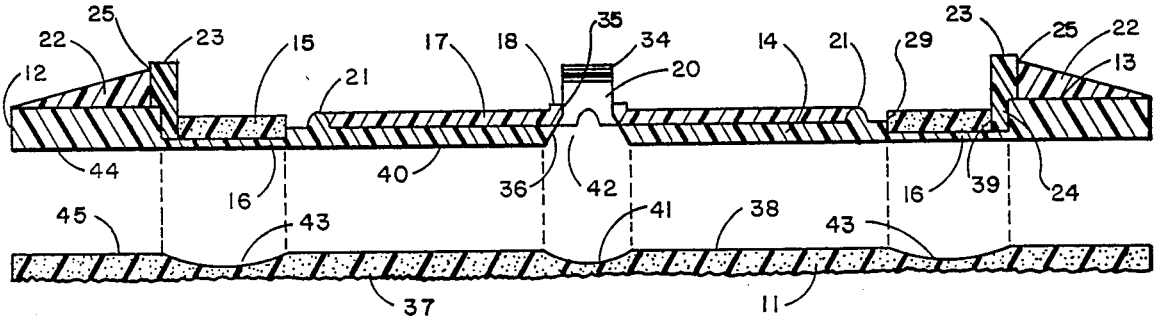
FIG. 3 is a sectional view through a loud speaker in accordance with the present invention having a ceiling tile facia attached to the front thereof.

Referring to the drawings FIGS. 1 through 3, a foamed polymer panel speaker 10 is shown in an exploded view in FIG. 1 which has a laminated ceiling tile facia 11 attached to a planar speaker panel 12. The planar speaker 12 has a periphery portion 13 formed in the molded foamed polymer speaker panel 12 which may be molded of an expanded polystyrene foam with the periphery portion 13 having a fairly high density to act as a frame portion. A diaphragm portion 14 may also have a high density foamed polymer and is held to the periphery portion with a resilient diaphragm suspension 16 which has a lower density than the periphery portion 13 or the diaphragm portion 14 to allow resilience or movement of the diaphragm 14 relative to the periphery 13 even though all three portions are molded in one molding operation of one continuous piece of foamed polymer material. A resilient diaphragm suspension insert 15 is adhesively attached along its edges 29 and 39 in the cutout portion 19 forming a continuous groove around the diaphragm portion 14. The insert 15 is formed of a resilient foamed rubber or elastomer to add additional flex to the foamed polymer diaphragm suspension 16 since the resilient suspension also acts as a return spring to the movement of the diaphragm 14. The diaphragm 14, in addition to having a high density foamed polymer, has a plurality of radially expanding ribs 17 for stiffening the diaphragm and each rib 17 extends between a smaller annular rib 18 extending around the voice coil former 20 and a rib 21 extending around the periphery of the diaphragm 14 along the edge of the resilient diaphragm suspension portion 15. The rigid periphery 13 has a plurality of frame support brackets 22 formed therein and a higher density foamed polymer.

It should be clear that the panel 12 is formed in one molding operation but is formed such that the different portions thereof may have a different density in the foamed polymer. The reduced density in the resilient diaphragm suspension 16 in combination with the attached insert 15 gives added resilience to allow the movement of the more rigid diaphragm 14 when driven by the voice coil former 20 which is fixedly attached to the diaphragm 14 with an adhesive or the like. The panel portions 13 and 22 are also of a high density foamed polymer to act as rigid frame portions for supporting the diaphragm or cone portion 14. A magnet holding frame 23 is formed in a square with each corner 24 being inserted into the end 25 of one of the frame holding brackets 22 where it can be adhesively attached thereto and also sitting in the edge of the cutout portion 19. The frame 23 is made of a structural foam polymer rather than a foamed polymer and is rigid and attached to the rigid periphery portion 13 of the panel 12. The frame 23 has cross supporting bars 46 and a plurality of metal bolts 26 molded into a center support 27. A light weight magnet 28 is mounted on a magnetic ring 30 with nuts 31 to the bolts 26 onto the center support surface 27. The magnet 28 has an opening 32 of predetermined size for fitting the voice coil former 20 therethrough. The frame 23 when mounted in the brackets 22 precisely aligns the opening 32 of the magnet 28 and the opening 33 through the support portion 27 of the frame directly in line with the voice coil former 20. The voice coil former 20 has a plurality of coil wrappings therearound and slides through the opening 33 and into the opening 32 of the magnet 28. The voice coil former 20 has a plurality of coil windings 34 on one end and extends through an opening 35 passing through the diaphragm 14. The voice coil former 20 has a flared end 36 as it extends through the diaphragm 14 and is used to produce higher frequencies directly through the panel 12.

As seen in FIG. 3, the ceiling tile facia 11 has an acoustical surface 37 on one side thereof and a smooth surface 38 on the other side thereof and is adhesively attached to the smooth surface 40 beneath the panel 12. The ceiling tile facia 11 has a removed portion 41 shaped in a generally dome shape but not extending all the way through the panel 11 and directly in line with the flared opening 42 of the voice coil former 20. In addition, the ceiling tile facia 11 has a removed portion 43 directly beneath the resilient diaphragm suspension 16 to separate the resilient diaphragm suspension 16 from the panel 11. The smooth inside surface 38 of the panel 11 is adhesively attached to the diaphragm surface 40 while the inside portion 44 of the periphery portion 13 of the panel 12 is adhesively attached to an inside portion 45 of the panel 11. The ceiling tile facia 11 is conventional in appearance except for the removed portions on the inside and when attached to the periphery portion 13 and the diaphragm 14 provides additional rigidity to these portions and has been acoustically matched to work with the speaker panel 12. The acoustic panel 11 is not attached and is separated from the resilient diaphragm suspension 16 and does not effect the resiliency of this portion. The dome portion 41 of the panel is directly below the voice coil former 20 flared portion and has reduced effect on the high frequencies being generated directly from the inside of the voice coil former 20 and acts as a dispersion lens to help disperse the higher frequencies. The ceiling tile 11 is a separate unit made of a foamed polyurethane polymer or the like that is attached to the speaker, and has been modified so that any ceiling tile surface pattern can be used.

Speaker systems in accordance with the present invention can be made for a wide variety of ceiling tile facia patterns by selecting the desired facia tile and removing portions therefrom and attaching it to the speaker portion so that speakers can be provided for any of a variety of ceiling tiles with only one speaker system and each ceiling tile has no visible grill or other indication of a speaker being mounted therein. In addition, the system is specifically designed to take advantage of the laminated ceiling tile facia attached to the speaker panel. The foamed polymer panel 12 can be molded in one foamed polymer molding operation but with varying densities. The groove 19 formed in the resilient diaphragm suspension isolates vibration and sound from the periphery portion 13 and from the frame 23 to provide improved sound from a ceiling or wall tile. The panel 12 can be made of a expanded polystyrene in which the densities of the periphery portion 13 and brackets can be 3.00 PCF while the densities of the resilient diaphragm suspension 16 can be between 1.25 and 1.50 PCF and the density of the diaphragm portion 14 can be between 3.00 and 3.25 PCF. The frame 23 can be made of a polyurethane plastic while the magnet 28 can be of a light weight plastic to reduce the weight of the overall acoustic transducer to allow it to be dropped into a suspended ceiling frame without additional bracing or modifications. However, the present invention is not to be considered limited to the form shown which is to be considered illustrative rather than restrictive.

I claim:

1. An acoustic transducer comprising:

a one piece sheet of foamed polymer material having different densities in different portions thereof, said different portions comprising a periphery portion of a first density, a diaphragm portion of a second density formed in the center of said one piece sheet of foamed polymer material, and a resilient diaphragm suspension portion separating said periphery portion and said diaphragm portion and said resilient diaphragm suspension portion having a third density lower than said periphery portion density; wherein said diaphragm portion has a plurality of reinforcing ribs formed thereon and has a foamed polymer surround ridge immediately adjacent said diaphragm suspension portion and intersecting said reinforcing ribs; a groove immediately adjacent said ridge and formed by said periphery portion, said resilient diaphragm suspension portion and said ridge;

a resilient insert attached in said groove in said one piece sheet of foamed polymer material;

a voice coil former fixedly attached to said diaphragm portion;

at least one frame support portion formed on said periphery portion; and a frame attached to said frame support portion and extending over a portion of said diaphragm portion, said frame having a magnet attached thereto in a position to be aligned with said voice coil former whereby a panel speaker is formed.

2. An acoustic transducer in accordance with claim 1 in which a laminated cover panel is fixedly attached to one side of said sheet of polymer material.

3. An acoustic transducer in accordance with claim 2 in which said voice coil former extends through said sheet of polymer material diaphragm portion.

4. An acoustic transducer in accordance with claim 3 in which said laminated cover panel has a portion removed part way therethrough adjacent said voice coil former attached to said foamed sheet of material.

5. An acoustic transducer in accordance with claim 4 in which said plurality of reinforcing ribs extend radially from the center of said diaphragm.

6. An acoustic transducer in accordance with claim 5 in which said voice coil is adhesively attached to said foamed polymer sheet diaphragm portion and has a flared cone shaped portion extending through said foamed polymer sheet diaphragm portion.

7. An acoustic transducer in accordance with claim 6 in which said laminated cover panel is an acoustical tile facia adhesively attached to said foamed polymer sheet.

8. An acoustic transducer in accordance with claim 7 in which said frame is a molded plastic frame.

9. An acoustic transducer in accordance with claim 2 in which a plurality of frame supports are each positioned to hold a corner of said frame.

10. An acoustic transducer in accordance with claim 9 in which said resilient diaphragm suspension has a density less than the density of said foamed polymer diaphragm.

11. An acoustic transducer in accordance with claim 10 in which said foamed polymer sheet is a foamed expanded polystyrene sheet have a plurality of densities at different portions thereof.

12. An acoustic transducer in accordance with claim 11 in which said laminated cover panel has a removed portion formed therein adjacent said resilient diaphragm suspension portion.

13. An acoustic transducer in accordance with claim 12 in which said frame has a polymer magnet mounted thereto, said polymer magnet having an opening formed therein for said voice coil former to extend thereinto.

14. An acoustic transducer in accordance with claim 13 in which said frame has a plurality of metal bolts formed therein to anchor said magnet thereto.

15. An acoustic transducer in accordance with claim 2 in which the laminated cover panel has a pattern on one side to emulate a pattern on an acoustic ceiling tile.

* * * * *